US006899447B2

(12) United States Patent
Wu

(10) Patent No.: US 6,899,447 B2
(45) Date of Patent: May 31, 2005

(54) EASILY ASSEMBLED LAMP RETAINING DEVICE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 129 days.

(21) Appl. No.: 10/421,031

(22) Filed: Apr. 24, 2003

(65) Prior Publication Data

US 2004/0213002 A1 Oct. 28, 2004

(51) Int. Cl.[7] ..... F21S 13/06; F21V 19/00

(52) U.S. Cl. ..... 362/382; 362/221; 362/226; 362/405; 362/581

(58) Field of Search ..... 362/382, 217, 362/221, 226, 368, 430, 431, 418, 581, 405, 406, 410, 389

(56) References Cited

U.S. PATENT DOCUMENTS 6,746,145 B1 * 6/2004 Wu ..... 362/581

* cited by examiner

*Primary Examiner*—Sandra O'Shea
*Assistant Examiner*—Mark Tsidulko

(57) ABSTRACT

An easily assembled lamp retaining device comprises a lamp seat firmly secured to a lateral side of a wire winding box, and a lamp rod inserted into the lamp seat. A front end of the lamp rod has an inserting block. The lamp rod has a buckling block which inserts into the slot so as to confine the movement of the lamp rod. The lamp rod has a flange. A top of the flange has a limiting hole. A pin is insert into the embedding hole of the embedding block to the limiting hole of the lamp rod so as to limit the lamp rod. The inserting block of the lamp rod inserts into the inserting seat so that the lamp seat is conductive to the lamp rod. Thereby, a user can assemble the lamp rod by inserting it into the lamp seat easily.

5 Claims, 7 Drawing Sheets

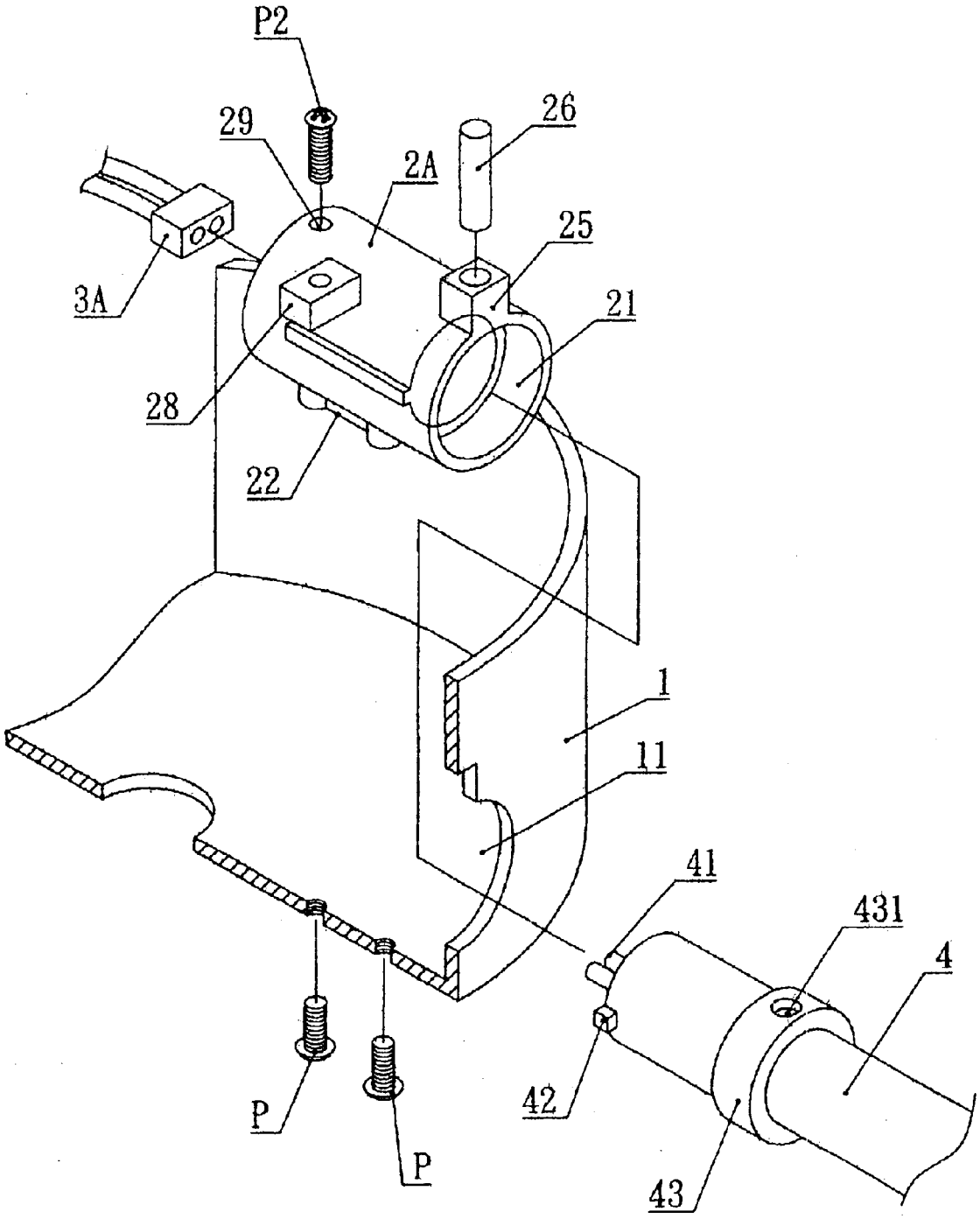
Fig. 1-A

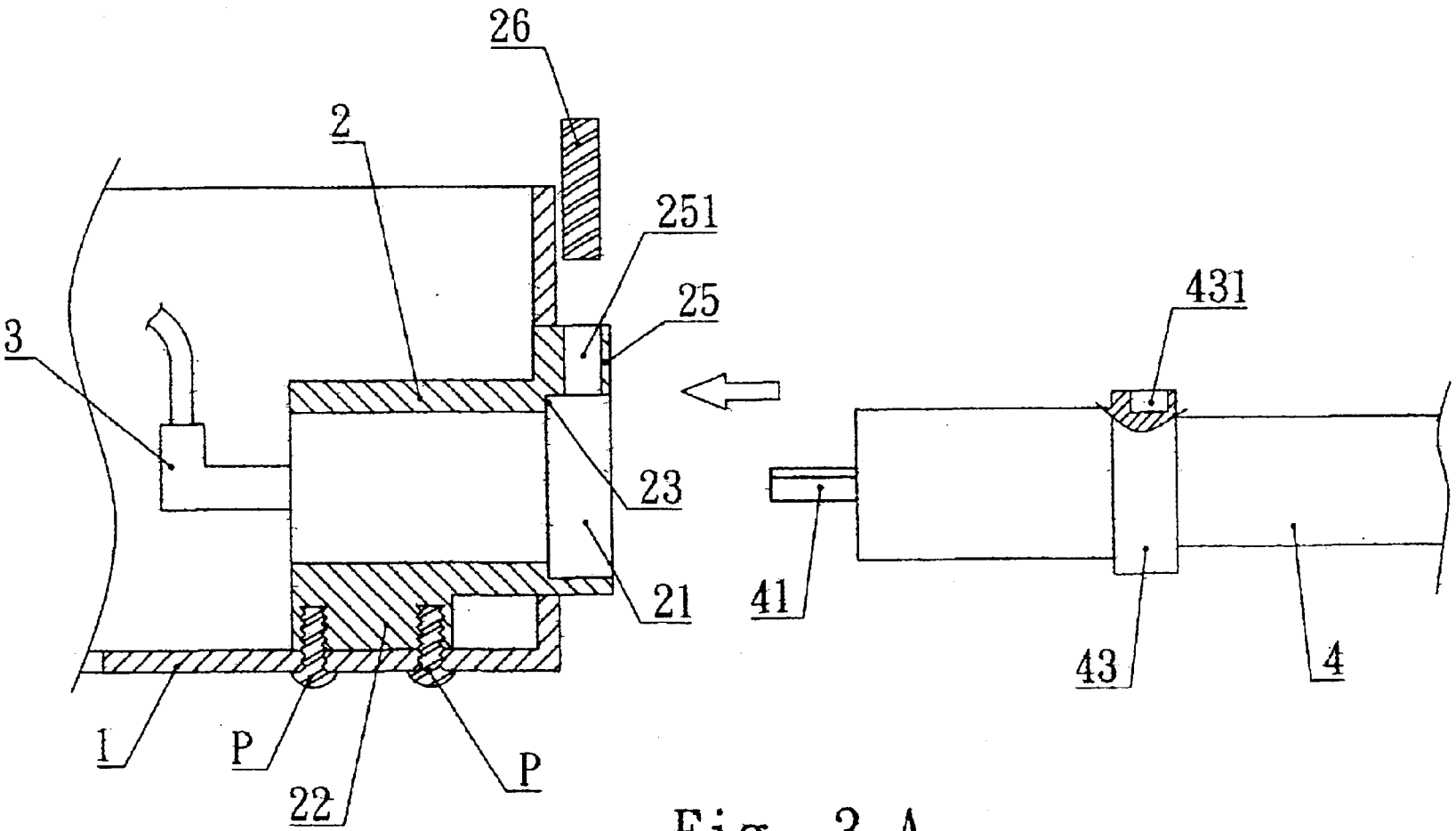
Fig. 3-A

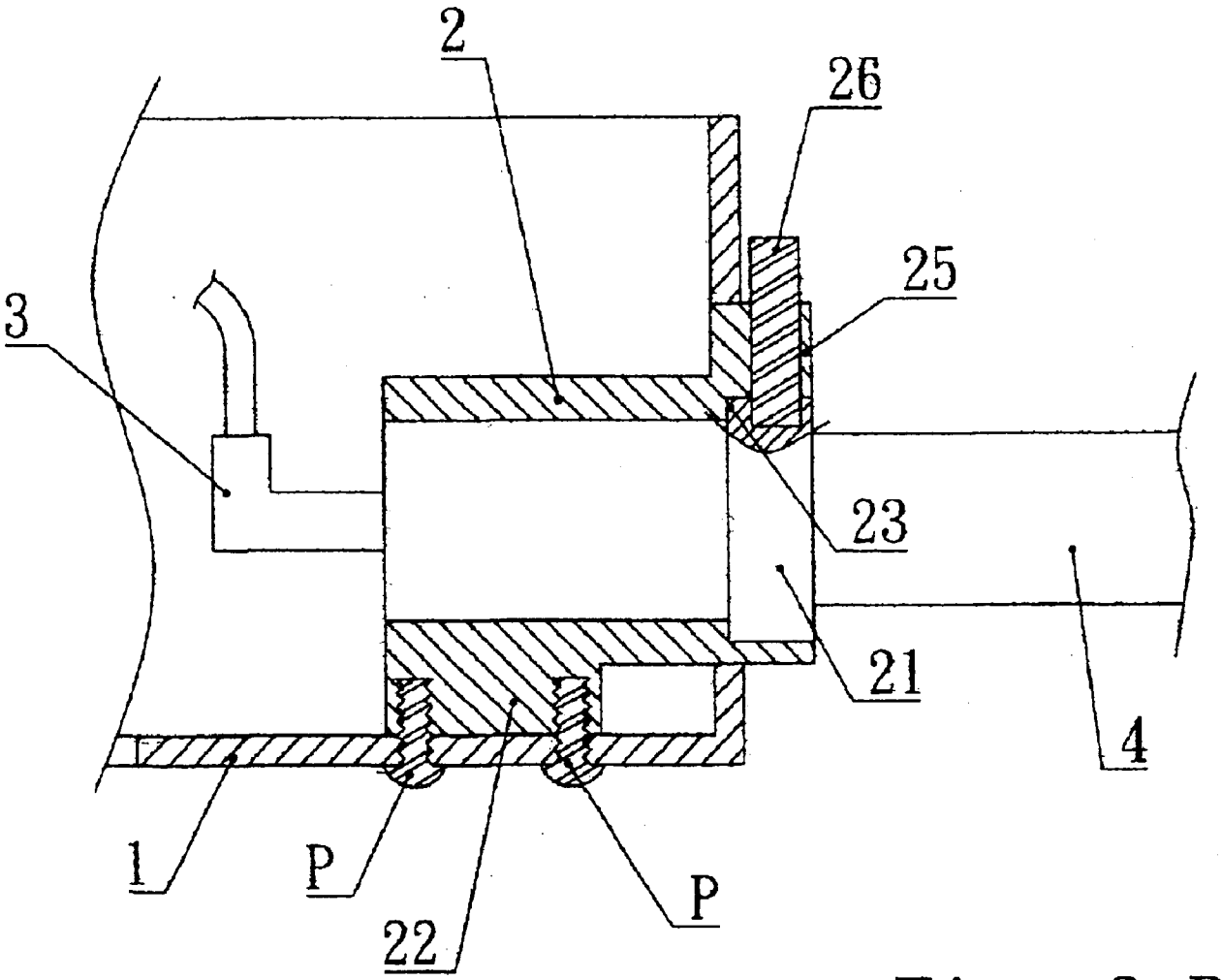
Fig. 3-B

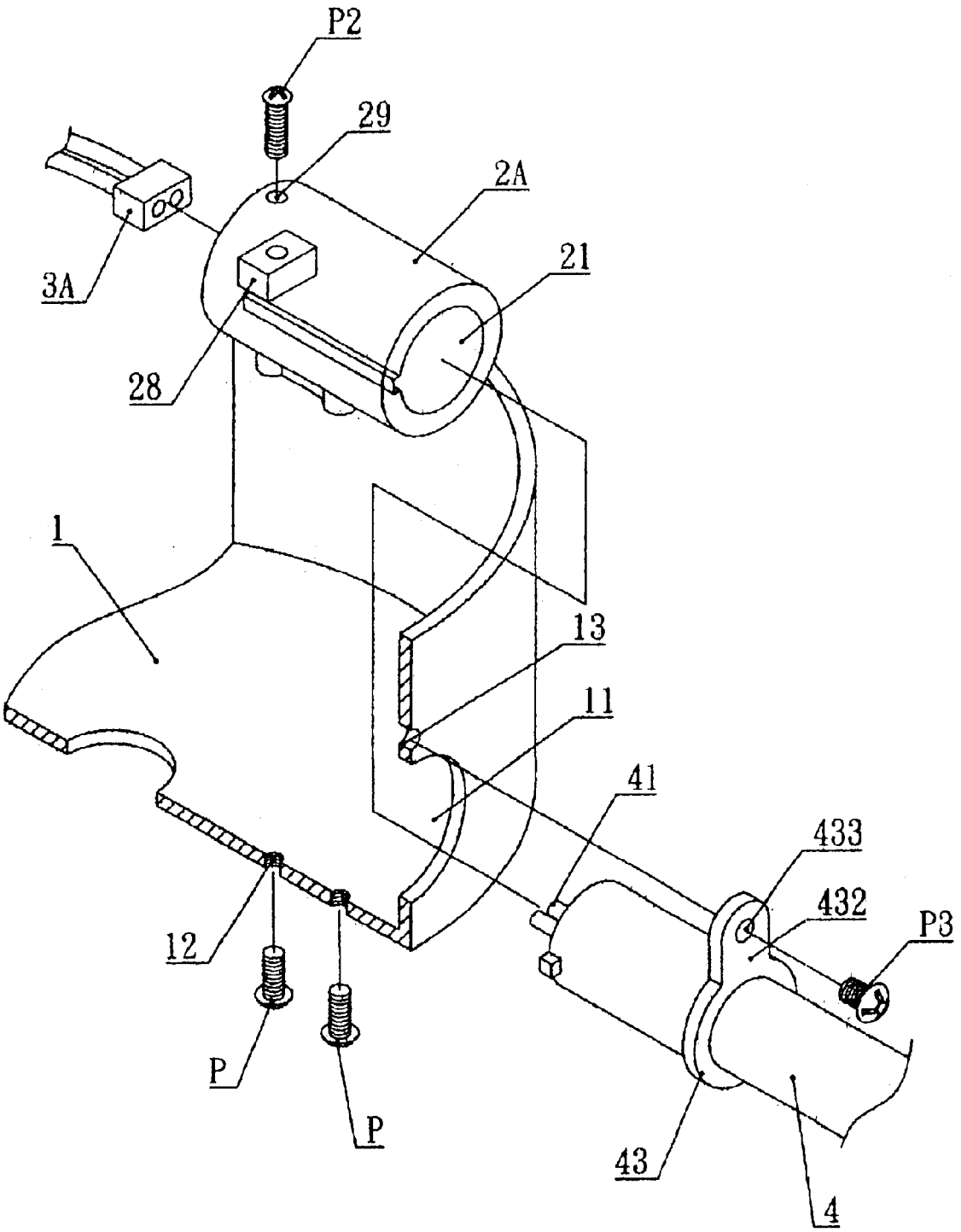
Fig. 4-A

EASILY ASSEMBLED LAMP RETAINING DEVICE

BACKGROUND OF THE INVENTION

The present invention relates to lamp assembly devices, and particularly to an easily assembled lamp retaining device with detachable elements. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision events easily occur, but also the locking tools (for example, spanners, openers, etc.) are necessarily used in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide an easily assembled lamp retaining device which comprises a lamp seat firmly secured to a lateral side of a wire winding box, and a lamp rod inserted into the lamp seat. A front end of the lamp rod has an inserting block. The lamp rod has a buckling block which inserts into the slot so as to confine the movement of the lamp rod; the lamp rod has a flange. A top of the flange has a limiting hole. A pin is insert into the embedding hole of the embedding block to the limiting hole of the lamp rod so as to limit the lamp rod. The inserting block of the lamp rod inserts into the inserting seat so that the lamp seat is conductive to the lamp rod. Thereby, a user can assemble the lamp rod by inserting it into the lamp seat easily.

The various objects and advantages of the present invention will be more readily understood from the following detailed description when read in conjunction with the appended drawing.

BRIEF DESCRIPTION OF THE DRAWINGS

FIGS. 1–1A shows one embodiment of the -present invention.

FIG. 3A shows the first embodiment about the condition before the lamp rod is assembled.

FIG. 3B shows the second embodiment about the condition after the lamp rod is assembled.

FIG. 4A is an exploded perspective view of the fourth embodiment of the present invention.

BRIEF DESCRIPTION OF THE PREFERRED EMBODIMENTS

Figure 1:
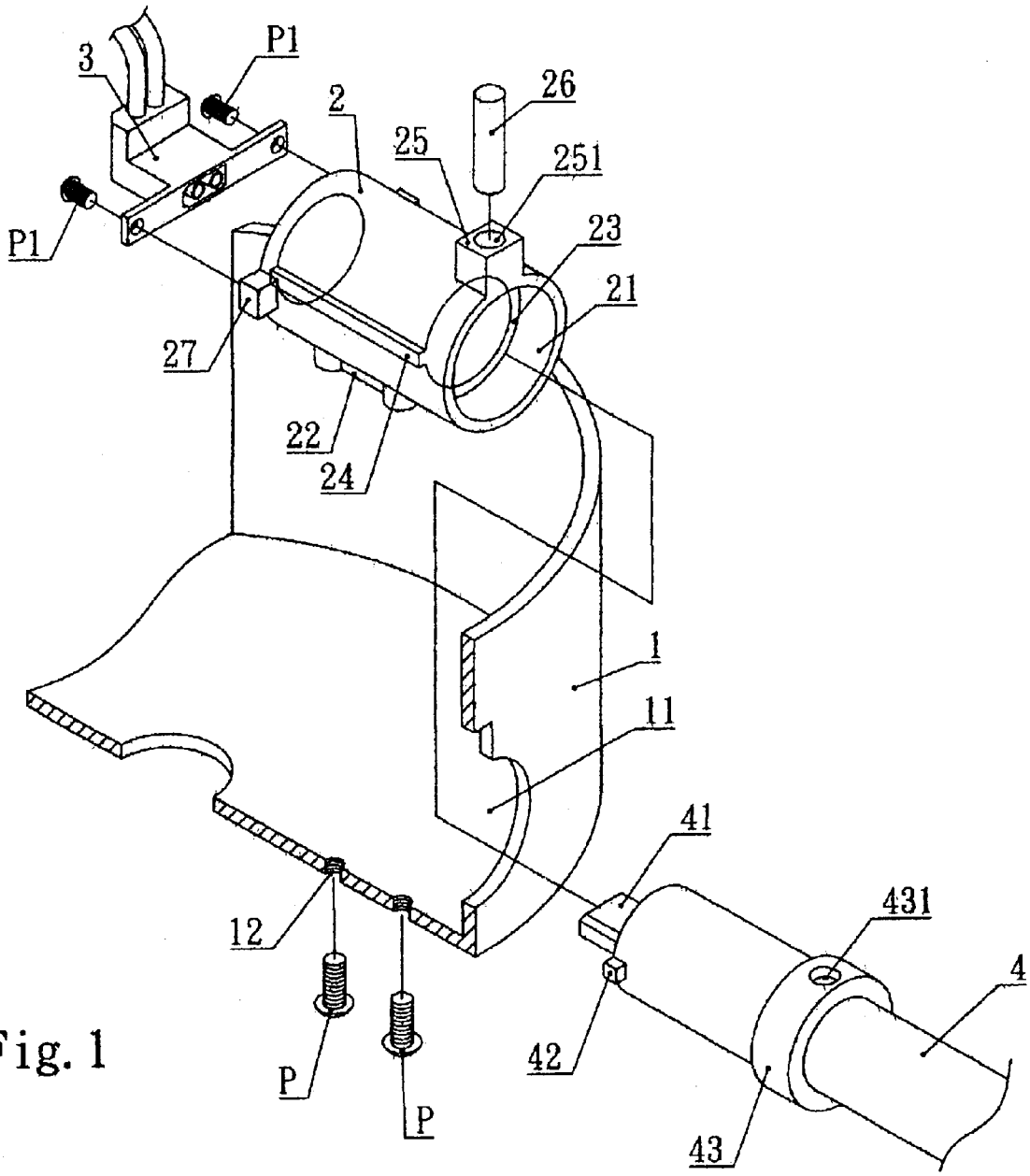
FIG. 1 is an exploded perspective view of the present invention
Figure 2:
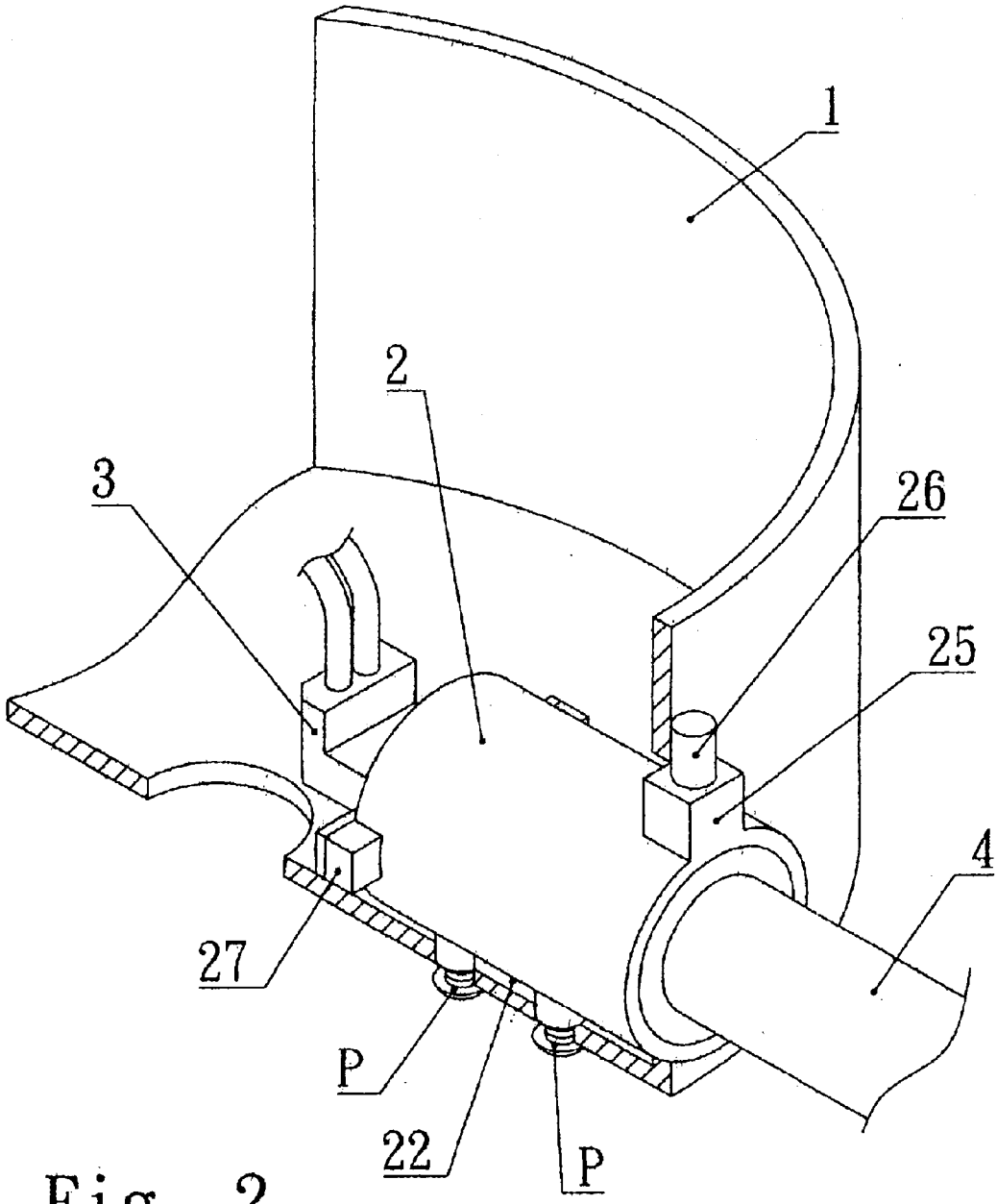
FIG. 2 is a schematic perspective view of the present invention.

Referring to FIGS. 1, 1A, and 2, the device of the present invention is illustrated. The present invention includes a lamp seat 2 firmly secured to a lateral side of a wire winding box 1, and a lamp rod 4 inserted into the lamp seat 2.

A lateral side of the wire winding box 1 has a via hole 11 and a bottom of the wire winding box 1 coupled to the lamp seat 2 has through holes 12. Studs P pass through the through hole to lock the lamp seat 2 to a predetermined positioned.

A portion of the lamp seat 2 coupled to the via hole 11 of the wire winding box 1 has a penetrating hole 21 and a bottom of the lamp seat 2 protruded with a locking seat 22 with a configuration corresponding to the through holes 12 of the wire winding box 1, thereby the studs P can pass through the through hole 12 from a lower end of the wire winding box 1 and then is locked to the locking seat 22 so as to fix the lamp seat 2 to the wire winding box 1. The lamp seat 2 has a stepped inner surface 23 near a front end thereof. An inner side of the stepped inner surface 23 is extended with a slot 24. One edge of the lamp seat 2 is protruded with an embedding block 25. An embedding hole 251 communicated to the penetrating hole 21 of the lamp seat 2 is formed in the embedding block 25. Thereby, when the lamp rod 4 inserts into the penetrating hole 21 of the lamp seat 2, a pin 26 is inserted into the embedding hole 251 to lock the lamp seat 2. Each of two opposite sides of the lamp seat 2 is protruded with a locking block 27. The lamp seat 2 is locked to an inserting seat 3 by studs P to pass through the blocks. The inserting block 41 of the lamp rod 4 resists against the inserting seat 3.

With reference to FIGS. 1–1A, a distal end of the lamp seat 2A is installed with an insertable slot 28. An upper side of the lamp seat 2 is installed with a screw hole 29. A stud P screws into the screw hole 29 to confine the inserting seat 3A to the lamp seat 2A.

A front end of the lamp rod 4 has an inserting block 41 capable of being inserted into the inserting seat 3. The lamp rod 4 has a buckling block 42 which can insert into the slot 26 so as to confine the movement of the lamp rod 4. The lamp rod 4 has a flange 43. A top of the flange 43 has a limiting hole 431 at a position corresponding to the embedding hole 251 of the lamp seat 2. Thereby, the pin 26 can insert into the embedding hole 251 of the embedding block 25 to the limiting hole 431 of the lamp rod 4 so as to limit the lamp rod 4. At this moment, the inserting block 41 of the lamp rod 4 inserts into the inserting seat 3 so that the lamp seat 2 is conductive to the lamp rod 4.

Referring to FIG. 3, in assembly, the buckling block 42 of the lamp rod 4 inserts into the slot 24 of the lamp seat 2 until the flange 43 of the lamp rod 4 resists against the stepped inner surface 23 of the lamp seat 2 so that the inserting portion 41 of the lamp rod 4 exactly inserts into the inserting seat 3 for conduction (referring to FIG. 3A). At this time, the locking hole 431 of the flange of the flange 43 of the lamp rod 4 aligns the slot 251 of the lamp seat 2 and the pin 26 inserts into the embedding hole 251 of the embedding block 25 of the lamp seat 2 and then into the limiting hole 431 of the lamp rod 4 so as to fix the lamp rod 4 (referring to FIG. 3B).

Figure 4:
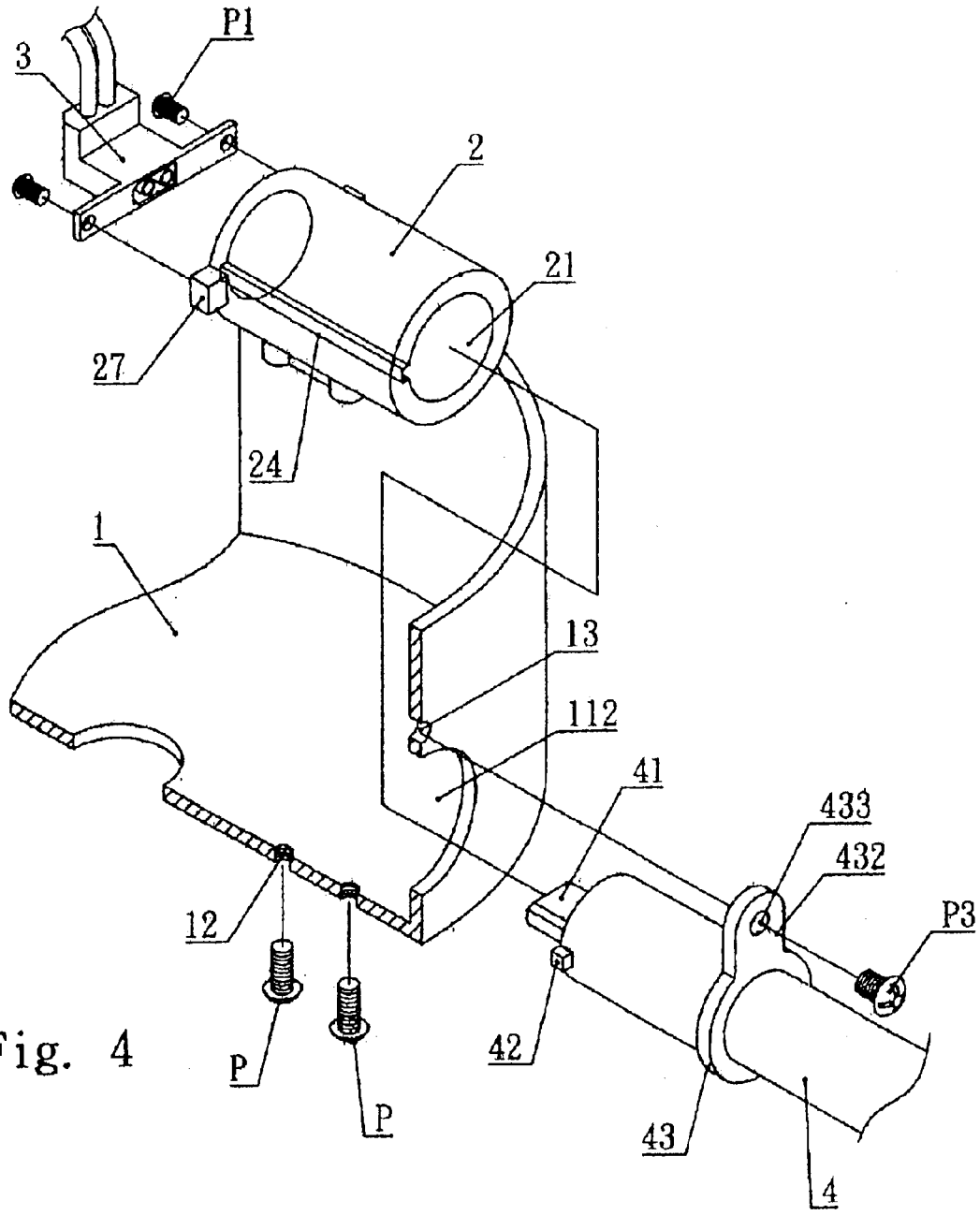
FIG. 4 is an exploded perspective view of another embodiment of the present invention.

Referring to FIGS. 4 and 4A, the second embodiment of the present invention is illustrated. An extension block 432 extends from an upper and of the flange 43 of the lamp rod 4. A via hole 433 is formed on the extension block 432. A locking hole 433 is formed on the wire wind box 1 at a position corresponding to the via hole 433 of the lamp seat 2. Thereby, when the buckling block 42 of the lamp rod 4 inserts through the slot 24 of the lamp seat 2, the extension block 432 of the lamp rod 4 can be adhered to an annular surface of the wire winding box and the via hole 433 is aligned to the locking hole 13 of the wire winding box, and then a stud P3 is used to lock the two elements.

By above said structure, in transferring or storage, the lamp rod 4 and the wire winding box 1 can be detached in advance so as to reduce the volume. In use, the user only needs to insert the lamp rod 4 into the lamp seat 2 without using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An easily assembled lamp retaining device comprising a lamp seat firmly secured to a lateral side of a wire winding box, and a lamp rod inserted into the lamp seat; wherein a lateral side of the wire winding box having a first via hole and a bottom of the wire winding box coupled to the lamp seat has through holes for being passed by first studs so as to lock the lamp seat to a predetermined positioned;

the lamp seat has a stepped inner surface near a front end thereof; an inner side of the stepped inner surface is extended with a slot; one edge of the lamp seat is protruded with an embedding block; an embedding hole communicated to the penetrating hole of the lamp seat is formed in the embedding block;

a front end of the lamp rod has an inserting block capable of being inserted into an inserting seat; the lamp rod has a buckling block which inserts into the slot so as to confine the movement of the lamp rod; the lamp rod has a flange; a top of the flange has a limiting hole at a position corresponding to the embedding hole of the lamp seat; a pin is insert into the embedding hole of the embedding block to the limiting hole of the lamp rod so as to limit the lamp rod; the inserting block of the lamp rod inserts into the inserting seat so that the lamp seat is conductive to the lamp rod;

thereby, a user can assemble the lamp rod by inserting it into the lamp seat easily; thus, the lamp is detachable for storage and transfer with a smaller volume.

2. The easily assembled lamp retaining device as claimed in claim 1, wherein a portion of the lamp seat coupled to the first via hole of the wire winding box has a penetrating hole and a bottom of the lamp seat protruded with a locking seat with a configuration corresponding to the through holes of the wire winding box, thereby the first studs passes through the through hole from a lower end of the wire winding box and then is locked to the locking seat so as to fix the lamp seat to the wire winding box.

3. The easily assembled lamp retaining device as claimed in claim 1, wherein each of two opposite sides of the lamp seat is protruded with a locking block; the lamp seat is locked to an inserting seat by studs to pass through the blocks; the inserting block of the lamp rod resists against the inserting seat.

4. The easily assembled lamp retaining device as claimed in claim 1, wherein an extension block extends from an upper and of the flange of the lamp rod; a second via hole is formed on the extension block; a locking hole is formed on the wire wind box at a position corresponding to the second via hole of the lamp seat; thereby, when the buckling block of the lamp rod inserts through the slot of the lamp seat, the extension block of the lamp rod is adhered to an annular surface of the wire winding box and the via hole is aligned to the locking hole of the wire winding box, and then a second stud is used to lock the lamp rod and the wire winding box.

5. The easily assembled lamp retaining device as claimed in claim 1, wherein a distal end of the lamp seat is installed with an insertable slot; an upper side of the lamp seat is installed with a screw hole; a stud screws into the screw hole to confine the inserting seat to the lamp seat.

* * * * *